US012768609B2

(12) United States Patent
Zimmer et al.

(10) Patent No.: US 12,768,609 B2
(45) Date of Patent: Oct. 20, 2026

(54) MAGAZINE FLOORPLATE ASSEMBLY WITH A TACTILE ROUND-COUNT INDICATOR

(71) Applicant: Division Group, LLC, Broussard, LA (US)

(72) Inventors: Trent Zimmer, Youngsville, LA (US); Benjamin Mahan, Martinsville, IN (US)

(73) Assignee: UNITY Tactical, LLC, Broussard, LA (US)

( * ) Notice: Subject to any disclaimer, the term of this patent is extended or adjusted under 35 U.S.C. 154(b) by 0 days.

(21) Appl. No.: 19/334,015

(22) Filed: Sep. 19, 2025

(65) Prior Publication Data

US 2026/0085902 A1 Mar. 26, 2026

Related U.S. Application Data

(60) Provisional application No. 63/697,647, filed on Sep. 23, 2024.

(51) Int. Cl.
*F41A 9/62* (2006.01)
*F41A 9/65* (2006.01)

(52) U.S. Cl.
CPC . *F41A 9/62* (2013.01); *F41A 9/65* (2013.01)

(58) Field of Classification Search
CPC ..... F41A 9/62; F41A 9/65
See application file for complete search history.

(56) References Cited

U.S. PATENT DOCUMENTS

| | | | |
|---|---|---|---|
| 387,531 | A | 8/1888 | Miller |
| 784,786 | A | 3/1905 | Gottardi |
| 790,634 | A | 5/1905 | Hirsh |
| 1,112,055 | A | 9/1914 | Amore |
| 1,202,768 | A | 10/1916 | Arnold |
| 1,252,094 | A | 1/1918 | De Lempdes |
| 1,992,934 | A | 3/1935 | Bamberger |
| 4,831,761 | A | 5/1989 | Kulakow |
| 5,291,679 | A | 3/1994 | Wollack et al. |

(Continued)

FOREIGN PATENT DOCUMENTS

GB 2498393 A 7/2013

OTHER PUBLICATIONS

CAA, MAG17—AR Magazine [online], [retrieved on Jan. 5, 2016], Retrieved from the internet <URL: https://usa.caagearup.com/mag17-ar-magazine>.

*Primary Examiner* — Jonathan C Weber
(74) *Attorney, Agent, or Firm* — Asgaard Patent Services, LLC; F. Wayne Thompson, Jr.

(57) ABSTRACT

A floorplate assembly with a tactile round-count indicator is disclosed. The assembly includes a floorplate, a tactile indicator, a plunger, and first and second spring elements. The floorplate is configured to be secured to a floor end of an ammunition magazine and includes a slot through which the tactile indicator moves between a retracted position and a protruding position. The plunger is operatively coupled to the tactile indicator and moves the tactile indicator to the protruding position when the plunger is depressed. The first spring element is configured to bias the tactile indicator toward the retracted position. The second spring element is configured to bias the plunger relative to the tactile indicator.

20 Claims, 10 Drawing Sheets

(56) References Cited

U.S. PATENT DOCUMENTS

| | | | | |
|---|---|---|---|---|
| 7,536,816 | B2 | 5/2009 | Weinberger | |
| 8,069,601 | B1 | 12/2011 | Fitzpatrick et al. | |
| 8,635,796 | B2 | 1/2014 | Fitzpatrick et al. | |
| 8,839,543 | B2 | 9/2014 | Fitzpatrick et al. | |
| 8,991,086 | B2 | 3/2015 | Fitzpatrick et al. | |
| 9,784,513 | B2 | 10/2017 | Zimmer | |
| 10,359,246 | B2 | 7/2019 | Faughn | |
| 10,393,457 | B2 | 8/2019 | Fitzpatrick et al. | |
| 11,015,890 | B2 | 5/2021 | Czarnecki et al. | |
| 11,719,497 | B2 | 8/2023 | Czarnecki et al. | |
| 2010/0251590 | A1 | 10/2010 | Fitzpatrick et al. | |
| 2011/0078936 | A1 | 4/2011 | Gates | |
| 2015/0075052 | A1 | 3/2015 | Boyarkin | |
| 2015/0267981 | A1* | 9/2015 | Faughn | F41A 9/62 42/1.02 |
| 2017/0003092 | A1* | 1/2017 | Faughn | F41A 9/62 |
| 2017/0191771 | A1* | 7/2017 | Zimmer | F41A 9/62 |
| 2019/0101347 | A1* | 4/2019 | Liptak | F41A 11/00 |
| 2019/0346224 | A1* | 11/2019 | Liptak | F41A 11/00 |

* cited by examiner

MAGAZINE FLOORPLATE ASSEMBLY WITH A TACTILE ROUND-COUNT INDICATOR

CROSS-REFERENCE TO RELATED APPLICATION(S)

This application claims the benefit of U.S. Provisional Application Ser. No. 63/697,647, filed on Sep. 23, 2024, the entirety of which is incorporated herein by reference.

TECHNICAL FIELD

This disclosure relates to implementations of a magazine floorplate assembly with a tactile round-count indicator.

BACKGROUND

Ammunition magazines generally include a floorplate secured to a floor end of the magazine body. The floorplate retains internal components such as a follower and a spring, and may also allow for disassembly for cleaning or maintenance.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

In certain circumstances, it may be desirable for a user to determine the number of rounds loaded in a magazine without visual inspection. For example, a user may wish to confirm whether a magazine is fully loaded while operating in low-light or no-light conditions. Conventional floorplates, however, generally do not provide a tactile indication of round count.

Disclosed are implementations of a floorplate assembly with a tactile round-count indicator. The tactile round-count indicator includes an indicator element configured to protrude from an underside of the floorplate when a predetermined number of rounds are loaded into an associated ammunition magazine.

In one example implementation, a floorplate assembly comprises a floorplate configured to be secured to a floor end of an ammunition magazine, the floorplate including a slot; a tactile indicator movable between a retracted position and a protruding position, the tactile indicator configured to protrude from an underside of the floorplate in the protruding position; a plunger operatively coupled to the tactile indicator and configured to move the tactile indicator to the protruding position when the plunger is depressed; a first spring element biasing the tactile indicator toward the retracted position; and a second spring element configured to bias the plunger relative to the tactile indicator.

In another example implementation, a floorplate assembly comprises a floorplate configured to be secured to a floor end of an ammunition magazine, the floorplate including a slot; an indicator movable between a first position and a second position, the indicator configured to protrude from an underside of the floorplate in the second position; a plunger operatively coupled to the indicator and configured to move the indicator to the second position when the plunger is depressed; a first biasing member biasing the indicator toward the first position; and a second biasing member engaged between the plunger and the indicator.

In yet another example implementation, an ammunition magazine comprises a magazine body; a follower disposed within the magazine body; and a floorplate assembly secured to a floor end of the magazine body. The floorplate assembly comprises a floorplate including a slot; a tactile indicator movable between a retracted position and a protruding position, the tactile indicator configured to protrude from an underside of the floorplate in the protruding position; a plunger operatively coupled to the tactile indicator and configured to move the tactile indicator to the protruding position when the plunger is depressed by the follower; a first spring element biasing the tactile indicator toward the retracted position; and a second spring element configured to bias the plunger relative to the tactile indicator.

Any of the implementations herein, wherein the first spring element is disposed within the tactile indicator.

Any of the implementations herein, wherein the first spring element generates a biasing force that is less than a biasing force generated by the second spring element.

Any of the implementations herein, wherein the second spring element is disposed around a portion of the plunger.

Any of the implementations herein, wherein the second spring element is disposed between an annular flange of the plunger and a rear end of the tactile indicator.

Any of the implementations herein, wherein the tactile indicator includes at least one stop configured to engage a rim of the slot in the floorplate and limit outward protrusion of the tactile indicator.

Any of the implementations herein, wherein the plunger comprises a first segment and a second segment separated by an annular flange.

Any of the implementations herein, wherein the first biasing member is disposed within the indicator.

Any of the implementations herein, wherein the first biasing member generates a biasing force that is less than a biasing force generated by the second biasing member.

Any of the implementations herein, wherein the second biasing member is disposed around a portion of the plunger.

Any of the implementations herein, wherein the second biasing member is disposed between an annular flange of the plunger and a rear end of the indicator.

Any of the implementations herein, wherein the indicator includes at least one stop configured to engage a rim of the slot in the floorplate and limit outward protrusion of the indicator.

Any of the implementations herein, wherein the second segment includes a locating feature configured to operatively couple the plunger to the tactile indicator.

Any of the implementations herein, further comprising a lock plate including a guide shaft for the plunger.

Any of the implementations herein, further comprising a lock plate including one or more guide grooves, each guide groove configured to receive a cantilever arm of the indicator, the guide grooves and cantilever arms configured to cooperate to slidably connect the indicator to the lock plate.

Any aspect of any implementation, in combination with any one or more aspects of any other implementation(s).

Any one or more of the features disclosed herein.

Any one or more of the features as substantially disclosed herein.

Any one or more of the features as substantially disclosed herein, in combination with any one or more other features as substantially disclosed herein.

Any one of the aspects, features, or implementations, in combination with any one or more other aspects, features, or implementations.

Use of any one or more of the aspects or features disclosed herein.

It should be appreciated that any feature described herein can be claimed in combination with any other feature(s) described herein, regardless of whether the features originate from the same described implementation.

The details of one or more aspects of the disclosure are set forth in the accompanying drawings and the description below. Other features, objects, and advantages of the techniques described in this disclosure will be apparent from the description and drawings, and from the claims.

Numerous additional features and advantages of the present disclosure will become apparent to those skilled in the art upon consideration of the implementation descriptions provided below.

Additional features and advantages are described herein and will be apparent from the following description and figures.

BRIEF DESCRIPTION OF THE DRAWINGS

Like reference numerals refer to corresponding parts throughout the several views of the drawings.

DETAILED DESCRIPTION

Figure 10:
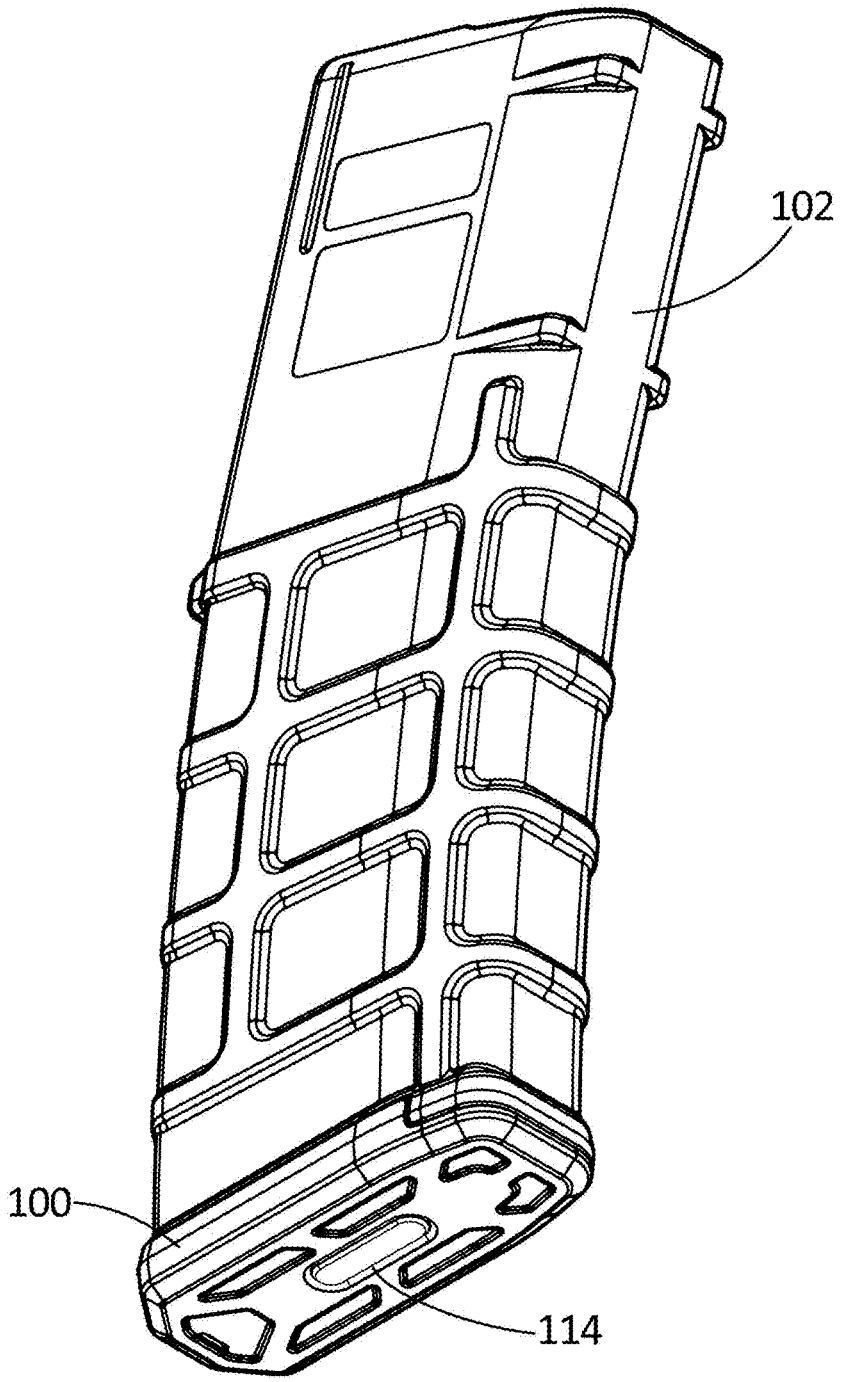
FIG. 10 is a perspective view of an ammunition magazine equipped with the magazine floorplate assembly shown in FIG. 1.

FIG. 1-9 illustrate a floorplate assembly 100 with a tactile round-count indicator according to the principles of the present disclosure. FIG. 10 illustrates the floorplate assembly 100 being used to enclose the floor end of an ammunition magazine 102.

The floorplate assembly 100 comprises a floorplate 110 and a tactile indicator assembly 112. The tactile indicator assembly 112 includes a tactile indicator 114 configured to protrude from the underside of the floorplate 110 in response to a predetermined number of rounds being loaded into the magazine 102. When the magazine 102 is loaded with the predetermined number of rounds, the follower engages the tactile indicator assembly 112, causing the tactile indicator 114 to protrude from the underside of the floorplate 110. In this way, a tactile indication of the number of rounds loaded into the magazine 102 is provided. In some implementations, the tactile indicator 114 is also configured to provide a visual indication of the number of rounds loaded into the magazine 102.

The floorplate 110 is configured to slide over a rim on the floor end of the magazine 102, using a ledge 116 to interface with the rim. The floorplate 110 includes a slot 118 through which the tactile indicator 114 protrudes when depressed by the follower of the magazine 102.

The tactile indicator assembly 112 may comprise a lock plate 120, a plunger 122, and the tactile indicator 114.

The lock plate 120 includes a guide shaft 124 for the plunger 122 and is configured to secure the floorplate 110 to the floor end of the magazine 102. The floorplate 110 and the lock plate 120 interface together, with the tactile indicator 114 positioned within the slot 118 of the floorplate 110 (see, e.g., FIG. 5). This arrangement prevents the floorplate 110 from being laterally dislodged from the rim of the magazine 102. The guide shaft 124 includes an interior channel 126 configured to guide the movement of the plunger 122 between a retracted position (see, e.g., FIG. 5) and an extended position (see, e.g., FIG. 8).

Figure 11:
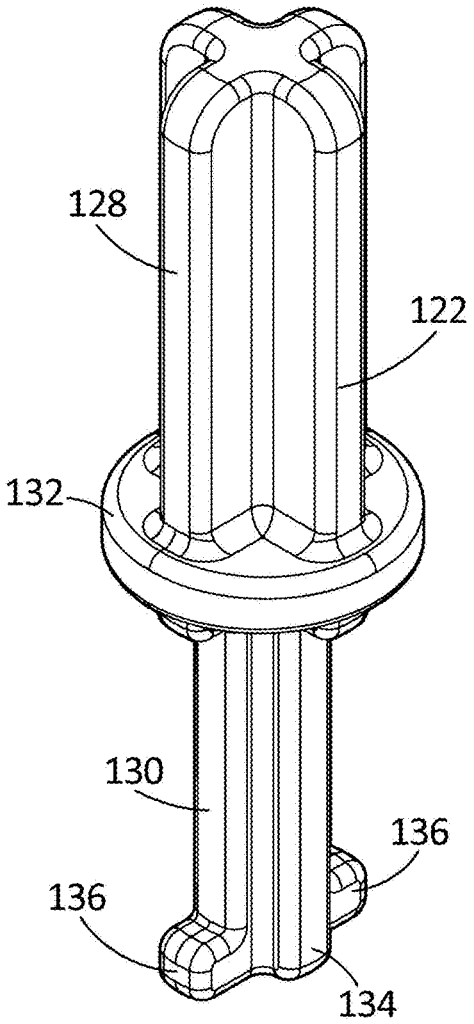
FIG. 11 is a perspective view of a plunger of the magazine floorplate assembly shown in FIG. 1.
Figure 12:
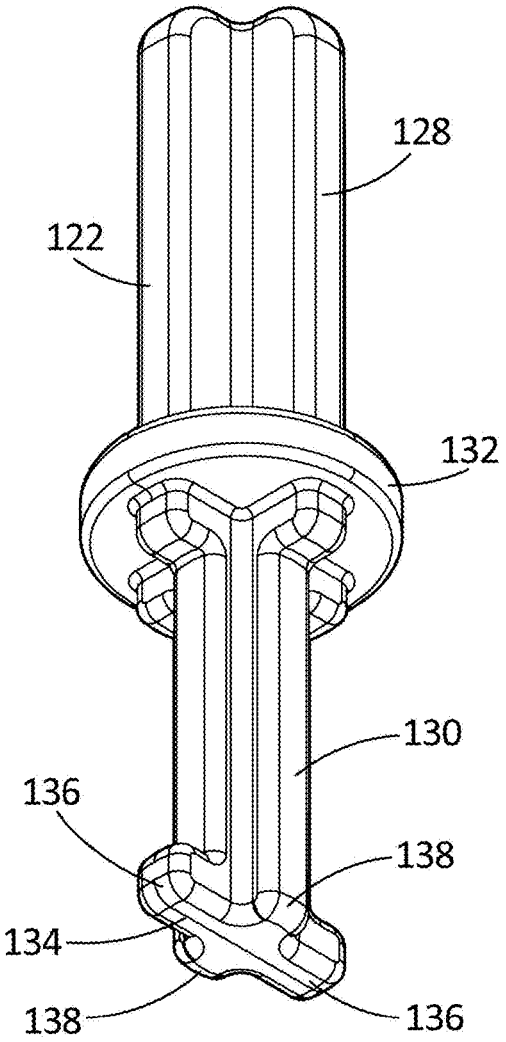
FIG. 12 is another perspective view of the plunger shown in FIG. 11.

As shown best in FIGS. 11 and 12, the plunger 122 may include a first segment 128 and a second segment 130, separated by an annular flange 132. The first segment 128 has a cross-shaped profile, and the second segment 130 includes a locating feature 134 at a distal end. The locating feature 134 is an asymmetric cruciform, with two long arms 136 positioned opposite each other and two short arms 138 positioned perpendicularly to the long arms 136. The annular flange 132 is configured to both slide up and down within the interior channel 126 of the guide shaft 124 and to keep the plunger 122 centered. The first segment 128 of the plunger 122 extends through an exit opening 142 at one end of the interior channel 126, which is configured to match the profile and slidably receive the first segment 128. The locating feature 134 of the second segment 130 extends through an opening 160 in the back end of the tactile indicator 114 and is operatively coupled to the tactile indicator 114. A wave spring 140 is positioned around the second segment 130 of the plunger 122, between the annular flange 132 and the tactile indicator 114 (see, e.g., FIG. 5). The two long arms 136 of the locating feature 134 on the second segment 130 are configured to be received by a pair of grooves 162 in the tactile indicator 114, capturing the wave spring 140 between the annular flange 132 of the plunger 122 and the rear end of the tactile indicator 114.

The wave spring 140, positioned around the second segment 130 of the plunger 122, generates a biasing force when compressed. While a wave spring 140 is used in the example implementation of the tactile indicator assembly 112, a suitable alternative spring element, such as a coil spring, may be used in some implementations.

The tactile indicator 114 is slidably connected to the underside of the lock plate 120 by two cantilever arms 144, each of which engages with a guide groove 146 in the base of the guide shaft 124. Each cantilever arm 144 includes a hook on its distal end and is configured to briefly deflect during insertion into the complementary guide groove 146.

Together, the guide grooves 146 retain the tactile indicator 114, and thereby the plunger 122 and wave spring 140, within the guide shaft 124 during installation and removal of the tactile indicator assembly 112 from the magazine 102.

Figure 14:
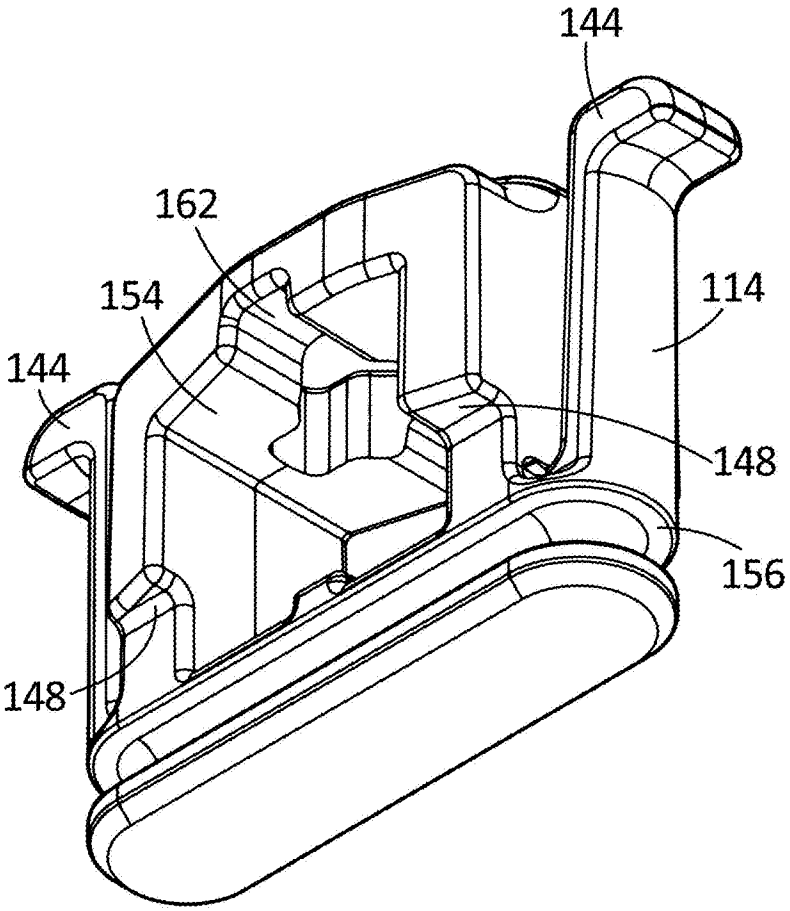
FIG. 14 is another perspective view of the tactile indicator shown in FIG. 13.
Figure 13:
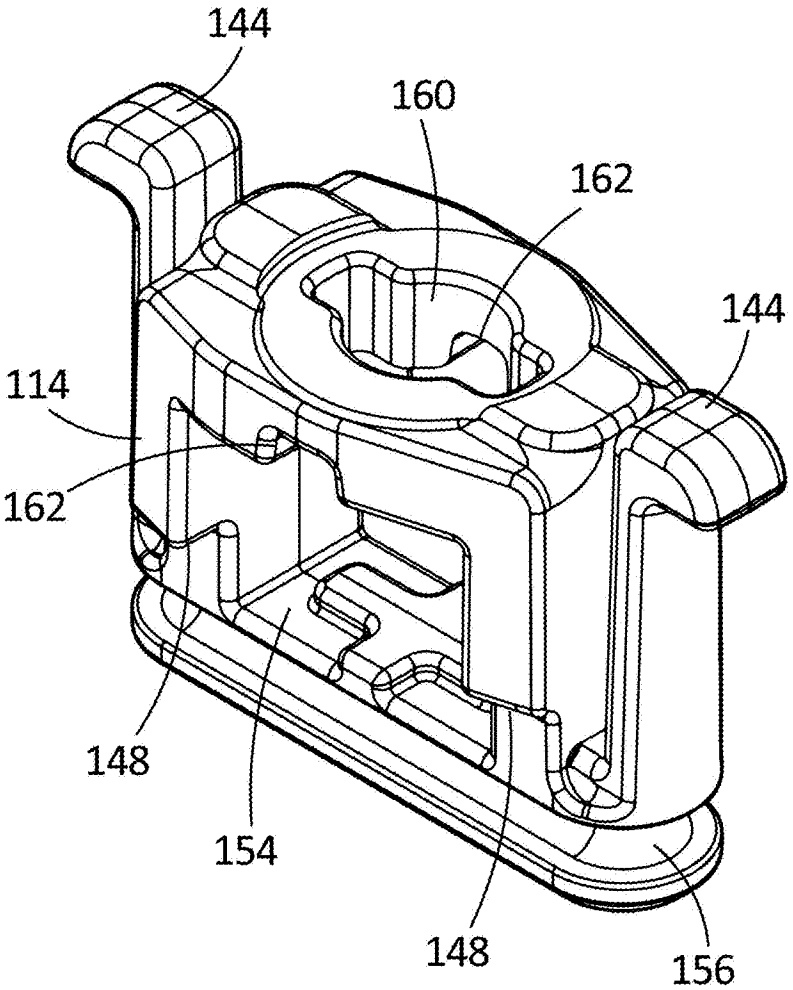
FIG. 13 is a perspective view of a tactile indicator of the magazine floorplate assembly shown in FIG. 1.

The tactile indicator 114 includes stops 148, as shown in FIGS. 13 and 14, that limit how far it can extend through the slot 118 in the floorplate 110 and protrude from its underside. Each stop 148 is a ledge configured to rest on the rim 150 of the slot 118, thereby limiting the protrusion of the tactile indicator 114 from the underside of the floorplate 110.

In some implementations, the tactile indicator 114 extends 0.1 inches from the underside of the floorplate 110 when in the extended position. In other implementations, the tactile indicator 114 may be configured to extend a different distance, either greater or less than 0.1 inches, from the underside of the floorplate 110.

Figure 1:
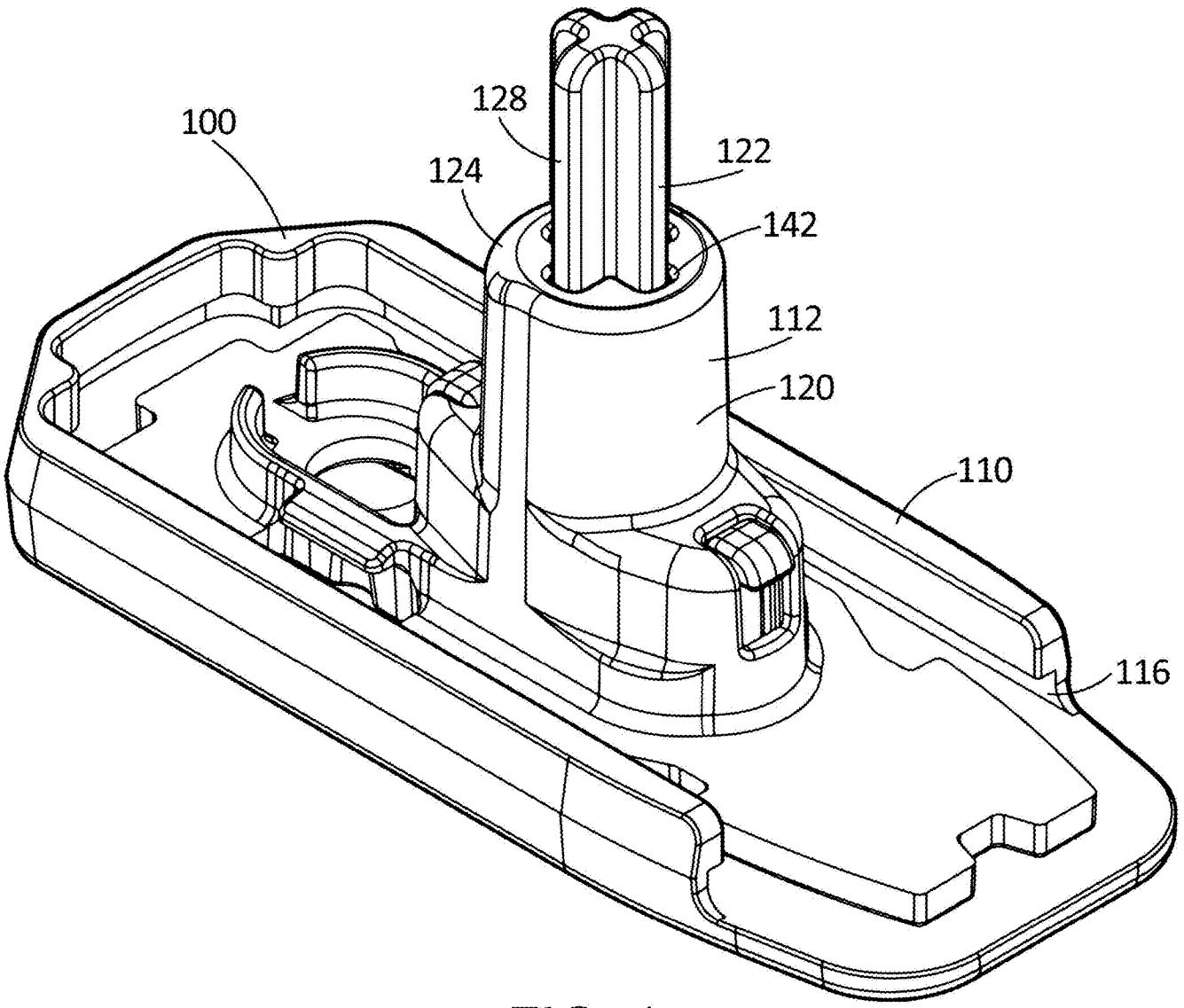
FIG. 1 is a perspective view of a magazine floorplate assembly according to the principles of the present disclosure.
Figure 2:
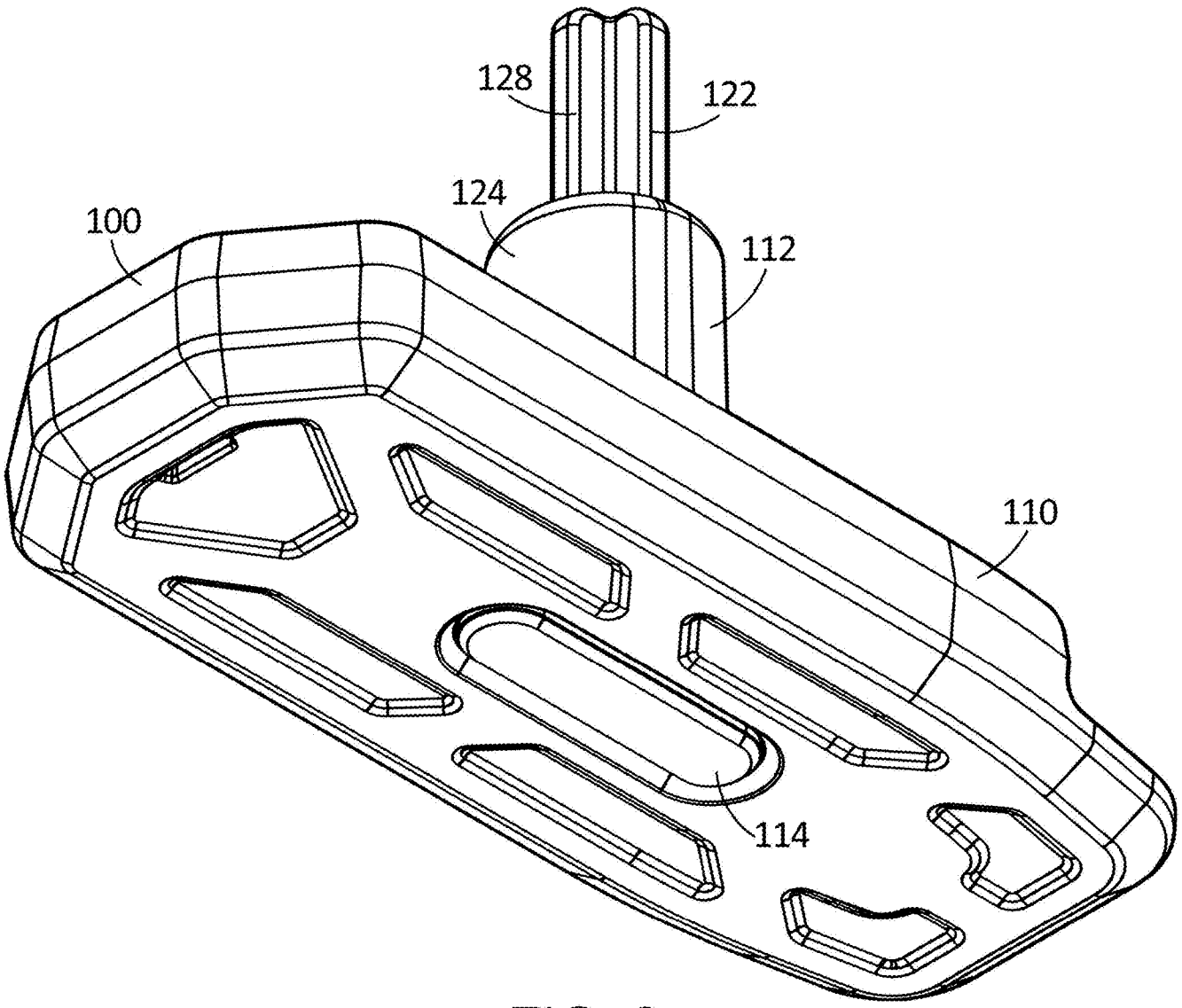
FIG. 2 is another perspective view of the magazine floorplate assembly shown in FIG. 1.
Figure 3:
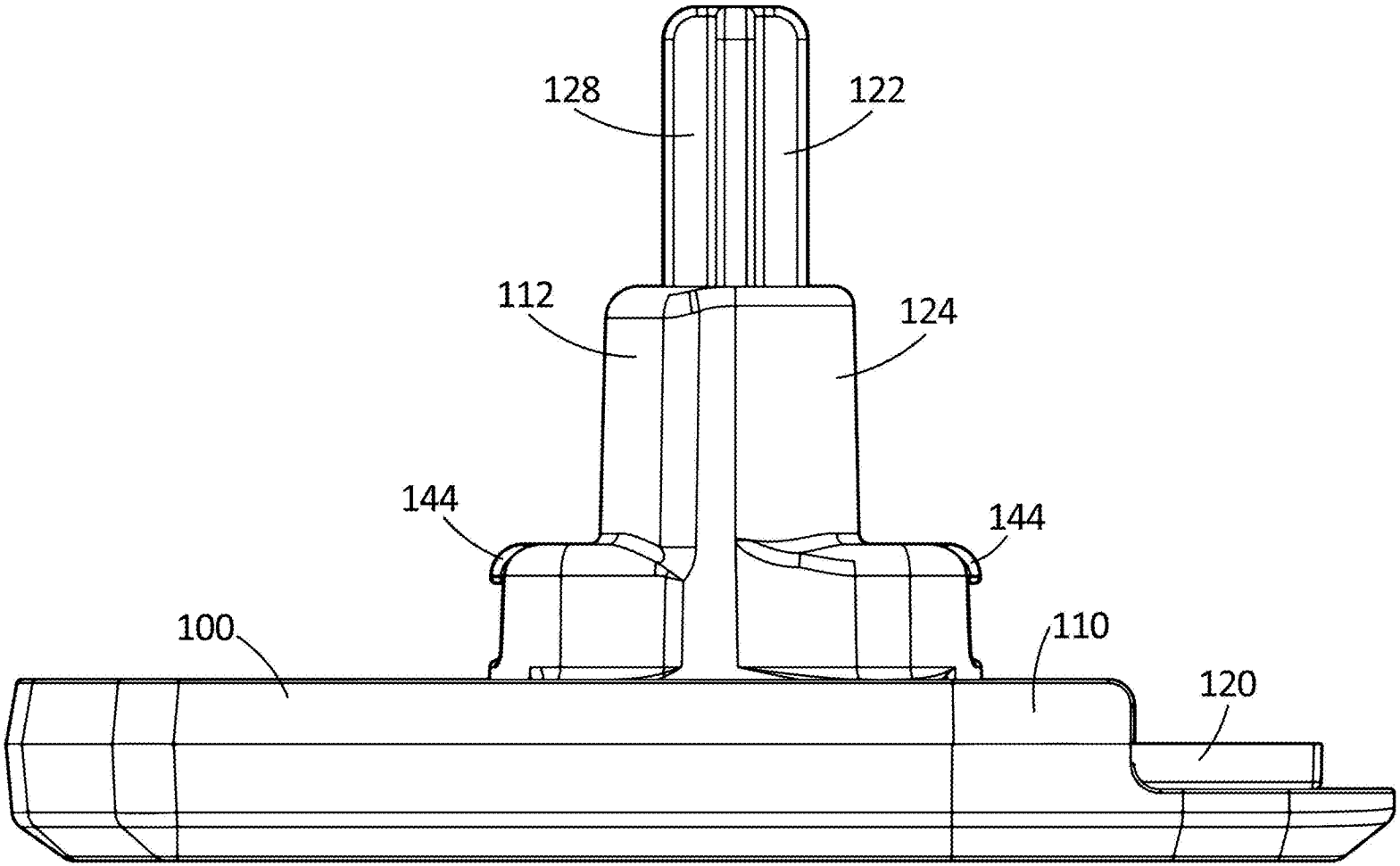
FIG. 3 is a side elevation view of the magazine floorplate assembly shown in FIG. 1.
Figure 4:
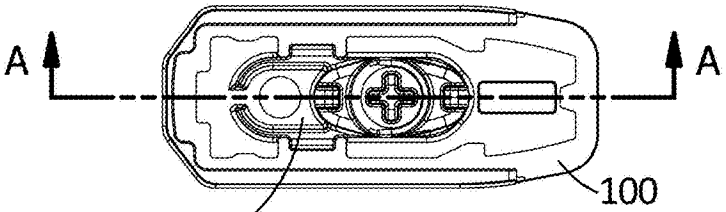
FIG. 4 is a top plan view of the magazine floorplate assembly shown in FIG. 3.
Figure 5:
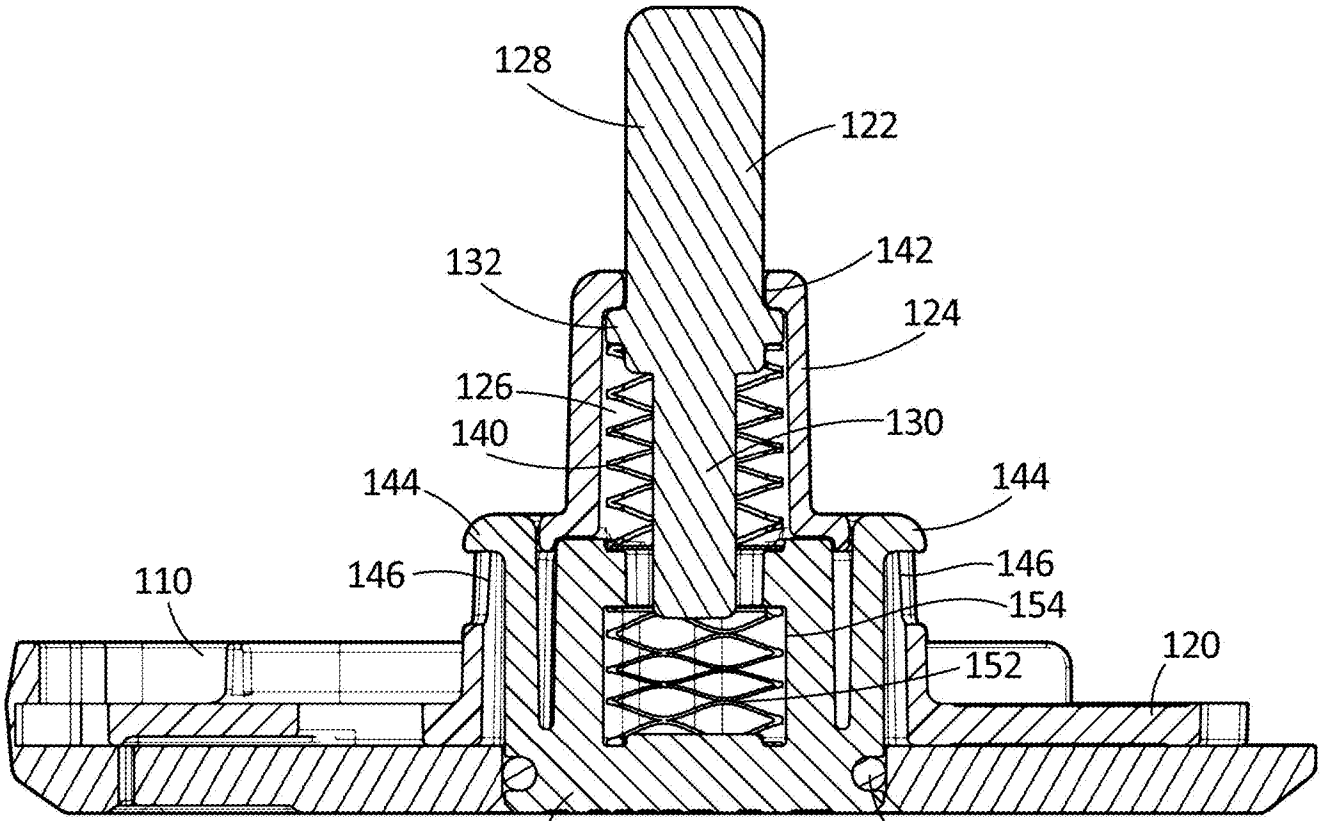
FIG. 5 is a cutaway view of the magazine floorplate assembly taken along line A-A of FIG. 4.
Figure 6:
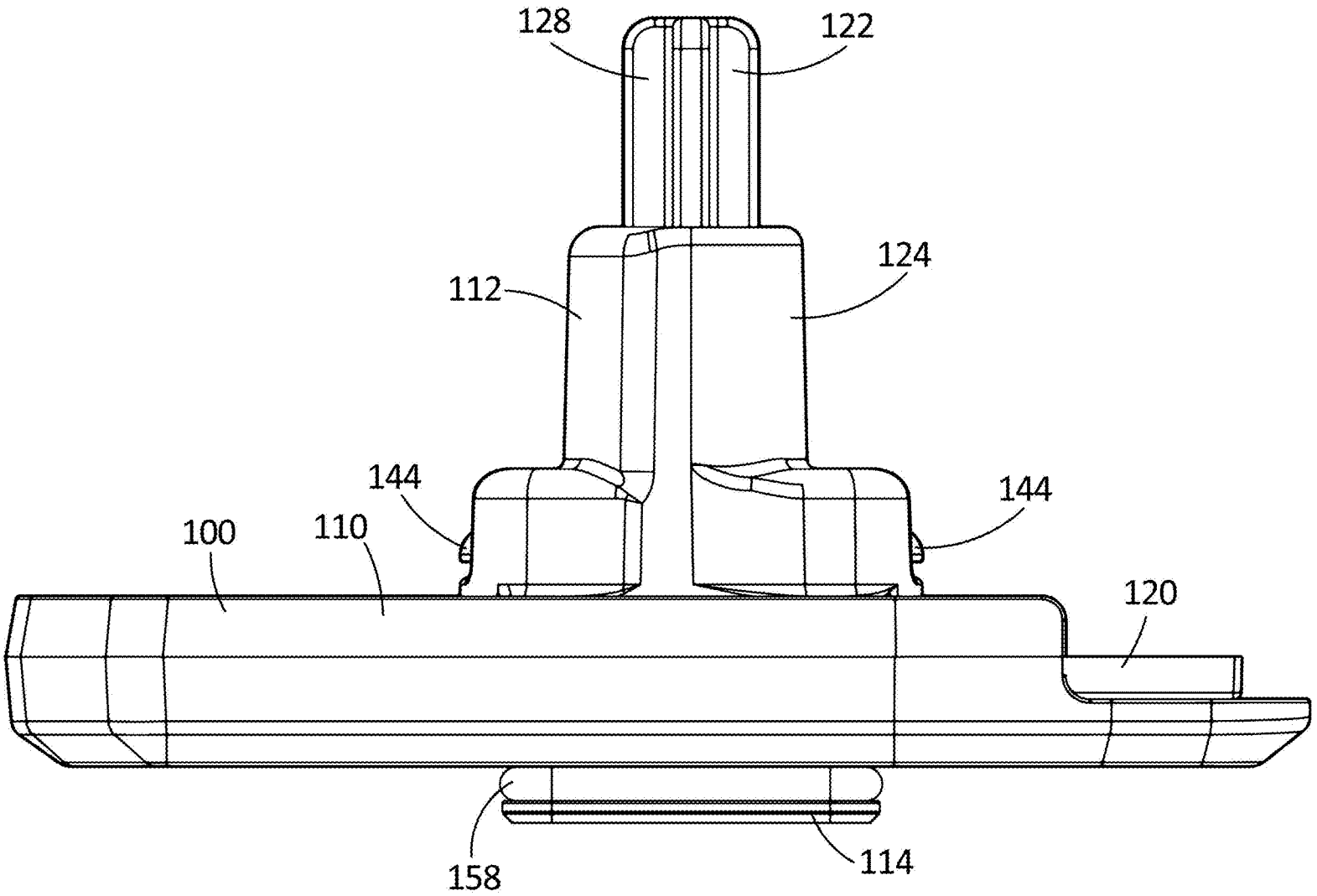
FIG. 6 is another side elevation view of the magazine floorplate assembly shown in FIG. 1, with the tactile indicator protruding from the underside of the floorplate.
Figure 7:
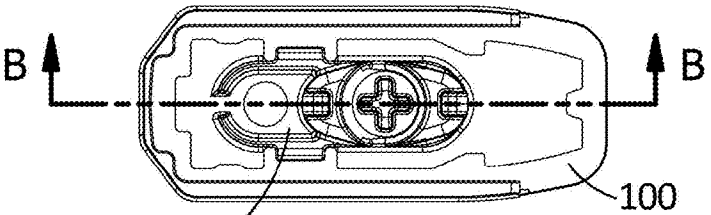
FIG. 7 is a top plan view of the magazine floorplate assembly shown in FIG. 6.
Figure 8:
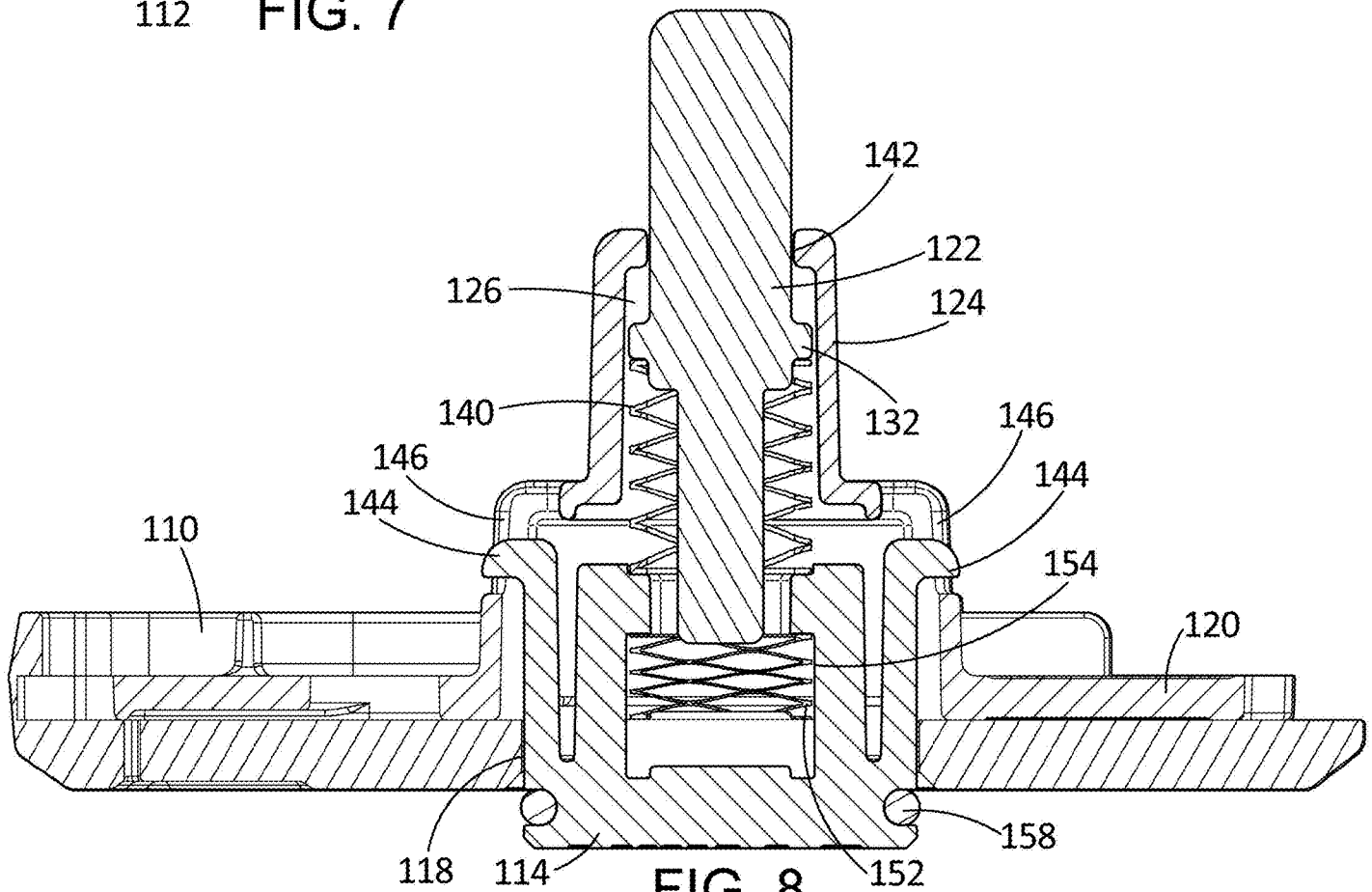
FIG. 8 is a cutaway view of the floorplate assembly taken along line B-B of FIG. 7.
Figure 9:
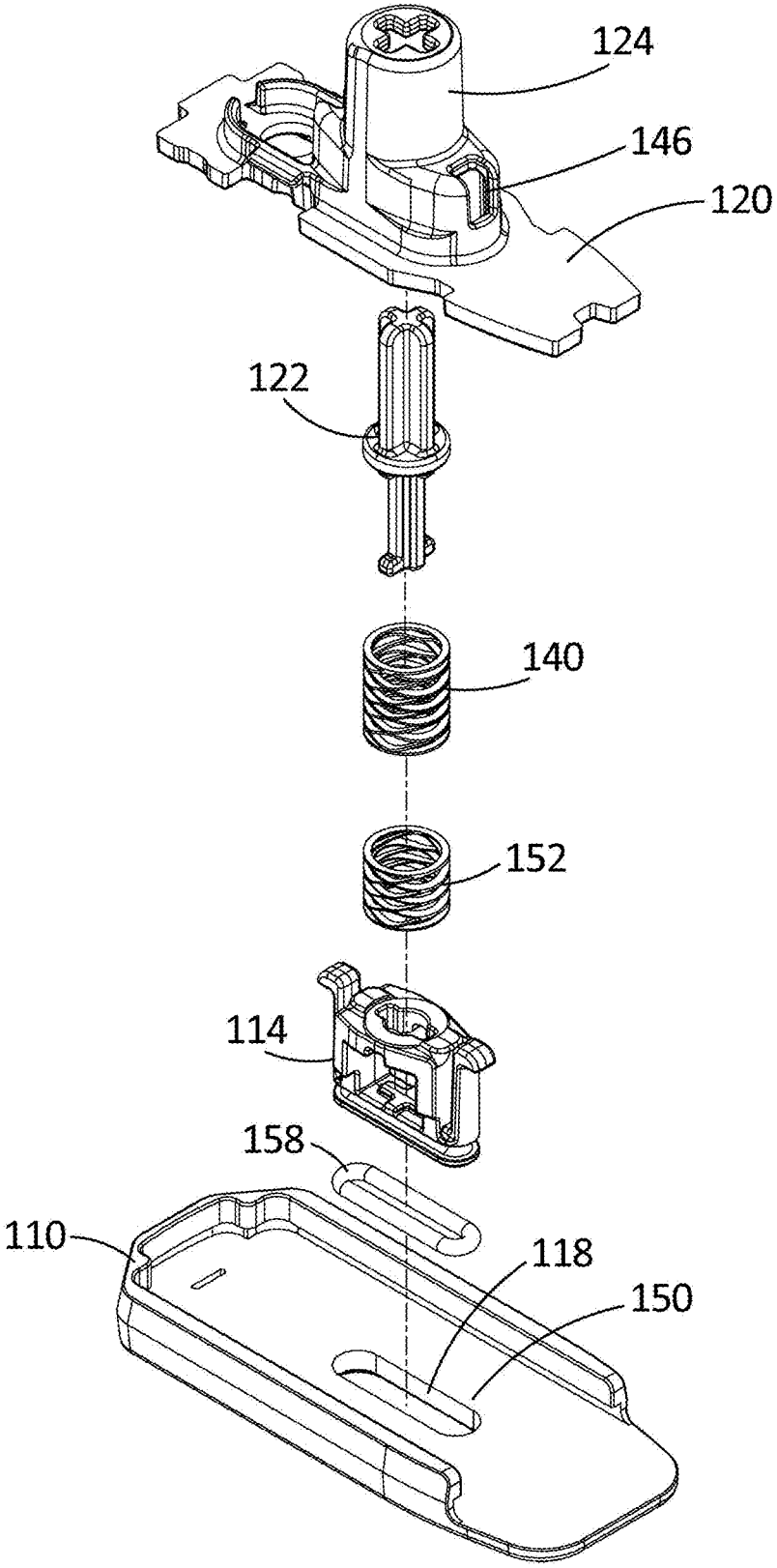
FIG. 9 is an exploded view of the magazine floorplate assembly shown in FIG. 1.

A wave spring 152 is positioned within a gap 154 defined by the tactile indicator 114, urging both the tactile indicator 114 and the plunger 122 toward their retracted positions (see, e.g., FIG. 5). The wave spring 152 has a larger diameter than the slot 118 in the floorplate 110. The two grooves 162, which receive the long arms 136 of the alignment feature 134 on the plunger 122, extend from opposite sides of the opening in the rear end of the tactile indicator 114 and are open towards the gap 154.

The wave spring 152, positioned within the gap 154 defined by the tactile indicator 114, generates a biasing force when compressed that is less than the biasing force produced by the other wave spring 140 in the tactile indicator assembly 112. While a wave spring 152 is used in the example implementation of the tactile indicator assembly 112, a suitable alternative spring element, such as a coil spring, may be used in some implementations.

The tactile indicator 114 also includes a circumferential groove 156 that houses an O-ring 158. The O-ring 158 may be any color, such as orange, blue, yellow, red, green, purple, or any hue thereof, that contrasts with the color of the floorplate 110. The circumferential groove 156, and therefore the O-ring 158, is positioned adjacent to the end of the tactile indicator 114. When the tactile indicator 114 protrudes from the slot 118 of the floorplate 110, it provides a visual indication of the number of rounds loaded into the magazine 102 (see, e.g., FIG. 6). In some implementations, the tactile indicator 114 may not include the circumferential groove 156 and O-ring 158. Instead, the tactile indicator 114 itself may be a color that contrasts with the color of the floorplate 110.

Operation

In the retracted position, the first segment 128 of the plunger 122 protrudes from the exit opening 142 of the guide shaft 124 into the travel path of the magazine follower. When the magazine 102 is loaded with the predetermined number of rounds, the follower depresses the plunger 122, causing the tactile indicator 114 to protrude from the underside of the floorplate 110. Specifically, when the plunger 122 is depressed, the wave spring 152 in the tactile indicator 114 is compressed until the stops 148 of the tactile indicator 114 rest on the rim of the slot 118 in the floorplate 110. The wave spring 140 around the second segment 130 of the plunger 122 does not substantially compress because it generates a greater biasing force than the other wave spring 152.

If an additional round is loaded into the magazine 102 or the loaded magazine 102 is inserted into a rifle with a closed breech, the magazine follower will further depress the plunger 122, causing the wave spring 140 around the second segment 130 of the plunger 122 to partially compress. This occurs because the tactile indicator 114 cannot be pushed further through the slot 118 in the floorplate 110, as the stops 148 rest on the rim 150 of the slot 118.

The tactile indicator assembly 112 is configured to prevent the tactile indicator 114 from breaking if a magazine 102 equipped with it is loaded with the predetermined number of rounds and then dropped. The tactile indicator assembly 112 is configured so that the tactile indicator 114 can be pushed back through the slot 118 by an external force, such as the impact from being dropped, without breaking. This is possible because the wave spring 140 around the second segment 130 of the plunger 122 can compress in response to the tactile indicator 114 being pushed in.

In some implementations, the predetermined number of rounds corresponds to the full capacity of the magazine equipped with the tactile indicator assembly 112. The example magazine 102 is designed to hold 30 rounds of ammunition. However, in other implementations, the tactile indicator assembly 112 may be configured so that the tactile indicator 114 protrudes from the underside of the floorplate 110 when the magazine 102 is loaded with fewer rounds, such as 28 or 29 rounds. In such an implementation, the first segment 128 of the plunger 122 may have an increased length. It should also be understood that the tactile indicator assembly 112 could be configured for use with magazines designed to have a different capacity, such as 20-round or 40-round magazines.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment," "implementation," or words of similar import indicates that a particular described feature, structure, or characteristic is included in at least one embodiment of the present disclosure. Thus, the phrase "in some implementations," or a phrase of similar import, as used throughout this specification, does not necessarily refer to the same embodiment.

The described features, structures, or characteristics may be combined in any suitable manner in one or more embodiments. In the above description, numerous specific details are provided for a thorough understanding of embodiments of the present disclosure. One skilled in the relevant art will recognize, however, that embodiments of the present disclosure can be practiced without one or more of the specific details, or with other methods, components, materials, etc. In other instances, well-known structures, materials, or operations may not be shown or described in detail.

The invention claimed is:

1. A floorplate assembly comprising:

a floorplate configured to be secured to a floor end of an ammunition magazine, the floorplate including a slot;

a tactile indicator movable between a retracted position and a protruding position, the tactile indicator configured to protrude from an underside of the floorplate in the protruding position;

a plunger operatively coupled to the tactile indicator and configured to move the tactile indicator to the protruding position when the plunger is depressed;

a first spring element biasing the tactile indicator toward the retracted position; and a second spring element configured to bias the plunger relative to the tactile indicator.

2. The floorplate assembly of claim 1, wherein the first spring element is disposed within the tactile indicator.

3. The floorplate assembly of claim 1, wherein the first spring element generates a biasing force that is less than a biasing force generated by the second spring element.

4. The floorplate assembly of claim 1, wherein the second spring element is disposed around a portion of the plunger.

5. The floorplate assembly of claim 1, wherein the second spring element is disposed between an annular flange of the plunger and a rear end of the tactile indicator.

6. The floorplate assembly of claim 1, wherein the tactile indicator includes at least one stop configured to engage a rim of the slot in the floorplate and limit outward protrusion of the tactile indicator.

7. The floorplate assembly of claim 1, wherein the plunger comprises a first segment and a second segment separated by an annular flange.

8. The floorplate assembly of claim 7, wherein the second segment includes a locating feature configured to operatively couple the plunger to the tactile indicator.

9. A floorplate assembly comprising:

a floorplate configured to be secured to a floor end of an ammunition magazine, the floorplate including a slot;

an indicator movable between a first position and a second position, the indicator configured to protrude from an underside of the floorplate in the second position;

a plunger operatively coupled to the indicator and configured to move the indicator to the second position when the plunger is depressed;

a first biasing member biasing the indicator toward the first position; and a second biasing member engaged between the plunger and the indicator.

10. The floorplate assembly of claim 9, wherein the first biasing member is disposed within the indicator.

11. The floorplate assembly of claim 9, wherein the first biasing member generates a biasing force that is less than a biasing force generated by the second biasing member.

12. The floorplate assembly of claim 9, wherein the second biasing member is disposed around a portion of the plunger.

13. The floorplate assembly of claim 9, wherein the second biasing member is disposed between an annular flange of the plunger and a rear end of the indicator.

14. The floorplate assembly of claim 9, wherein the indicator includes at least one stop configured to engage a rim of the slot in the floorplate and limit outward protrusion of the indicator.

15. The floorplate assembly of claim 9, further comprising a lock plate including a guide shaft for the plunger.

16. The floorplate assembly of claim 9, further comprising a lock plate including one or more guide grooves, each guide groove configured to receive a cantilever arm of the indicator, the guide grooves and cantilever arms configured to cooperate to slidably connect the indicator to the lock plate.

17. An ammunition magazine comprising:

a magazine body;

a follower disposed within the magazine body; and a floorplate assembly secured to a floor end of the magazine body, the floorplate assembly comprising:

a floorplate including a slot;

a tactile indicator movable between a retracted position and a protruding position, the tactile indicator configured to protrude from an underside of the floorplate in the protruding position;

a plunger operatively coupled to the tactile indicator and configured to move the tactile indicator to the protruding position when the plunger is depressed by the follower;

a first spring element biasing the tactile indicator toward the retracted position; and a second spring element configured to bias the plunger relative to the tactile indicator.

18. The ammunition magazine of claim 17, wherein the tactile indicator includes at least one stop configured to engage a rim of the slot in the floorplate and limit outward protrusion of the tactile indicator.

19. The ammunition magazine of claim 17, further comprising a lock plate including a guide shaft for the plunger.

20. The ammunition magazine of claim 17, further comprising a lock plate including one or more guide grooves, each guide groove configured to receive a cantilever arm of the tactile indicator, the guide grooves and cantilever arms configured to cooperate to slidably connect the tactile indicator to the lock plate.

* * * * *